United States Patent [19]

Devoe

[11] 3,982,570

[45] Sept. 28, 1976

[54] JAR FILLING FUNNEL WITH LEVEL INDICIA

[75] Inventor: Donald R. Devoe, Edina, Minn.

[73] Assignee: Leisure Technology, Inc., Savage, Minn.

[22] Filed: July 2, 1975

[21] Appl. No.: 592,549

[52] U.S. Cl. ..... 141/95

[51] Int. Cl.[2] ..... B65B 1/30

[58] Field of Search ..... 141/95, 199–205, 141/297–300, 331–335, 198

[56] References Cited

UNITED STATES PATENTS 1,425,100 8/1922 Jones et al. ..... 141/335

*Primary Examiner*—Robert I. Smith

*Attorney, Agent, or Firm*—James R. Cwayna

[57] ABSTRACT

A funnel, particularly designed for filling canning jars and the like which includes a wide mouthed receiving end and a comparatively small mouthed delivery end which delivery end is designed to be received into a canning jar with an area adjacent the delivery end formed to provide a locating stop against the top of the jar to be filled such that the delivery end will extend into the jar a predetermined distance. The delivery end of the funnel is provided with a level marking indicia interiorially thereof whereby filling of the jar to either this predetermined level or to the bottom of the funnel will provide a proper expansion and contraction area between the foodstuff in the jar and the lid or cover that is placed on the jar.

2 Claims, 3 Drawing Figures

JAR FILLING FUNNEL WITH LEVEL INDICIA

FIELD OF THE INVENTION

This invention relates generally to devices for proper filling of containers and the like and more specifically to a funnel for filling canning jars with food to be preserved with means for indicating a proper level of filling of the jar with food such that a proper air space will exist between the foodstuffs and the top of the jar to insure proper sealing of the lid to the jar.

BACKGROUND AND OBJECTS OF THE INVENTION

Canning of foods for the preservation thereof is well known in the art and the problems inherent thereto are also well known in the art. In order to properly preserve foods through canning, it is necessary that a proper air seal be maintained so as to prevent the growth of bacteria and thus the spoilage of food. In order to properly insure that air is driven from the food inserted into the jar, it is often necessary to heat the entire jar to thus drive the air from the liquid or the food contained in the jar and thereafter upon cooling of the jar, the lid will be drawn downwardly onto the jar thus properly sealing the jar and the contained foodstuffs against air. In this entire process, it is necessary, in order to maintain a clean jar-to-lid seal, that only air be driven from the foodstuffs and the interior of the jar and that no portions of the food placed in the jar come between the lid and the jar. Therefore, in filling the jar, it is necessary that a proper level of filling be maintained such that upon heating of the same and the expansion of the foodstuffs therein an area of expansion between the food and the lid and the rim of the jar be provided and which thereafter, upon cooling of the jar and the foodstuffs, will permit the draw down of the lid into proper vacuum sealing against the jar rim without contacting the foodstuffs.

Therefore, it is necessary in the canning of various products that are subject to a heat process, that an area of expansion and contraction be allowed between the foodstuffs and the rim-lid sealing area.

It is therefore an object of applicant's invention to provide a filling funnel for the placement of food to be preserved into a storage jar which will assist in the insertion of the food into the jar without spilling the same on the rim and sealing area of the jar.

It is a further object of applicant's invention to provide a funnel or filling device for the insertion of foodstuffs for preserving into a jar, which will provide a means for easily controlling the proper level of the material being placed into the jar.

It is a further object of applicant's invention to provide a funnel mechanism which is provided with a substantially large receiving end and a relatively smaller delivery end, which delivery end is designed for insertion into the mouth of a jar to be filled and wherein the funnel will rest upon the rim of the jar to be filled.

It is still a further object of applicant's invention to provide a funnel or filling device for filling jars with food to be preserved which includes a relatively large receiving end and a comparatively smaller delivery end which delivery end is arranged to be received and designed to be received into the mouth of a jar to be filled and which delivery end is provided with marking indicia on the interior thereof which will indicate a proper level of filling of the jar.

These and other objects and advantages of the invention will more fully appear from the following description made in connection with the accompanying drawings in which the same numeral is used to designate the same or similar parts throughout the several views, and in which.

Figure 1:
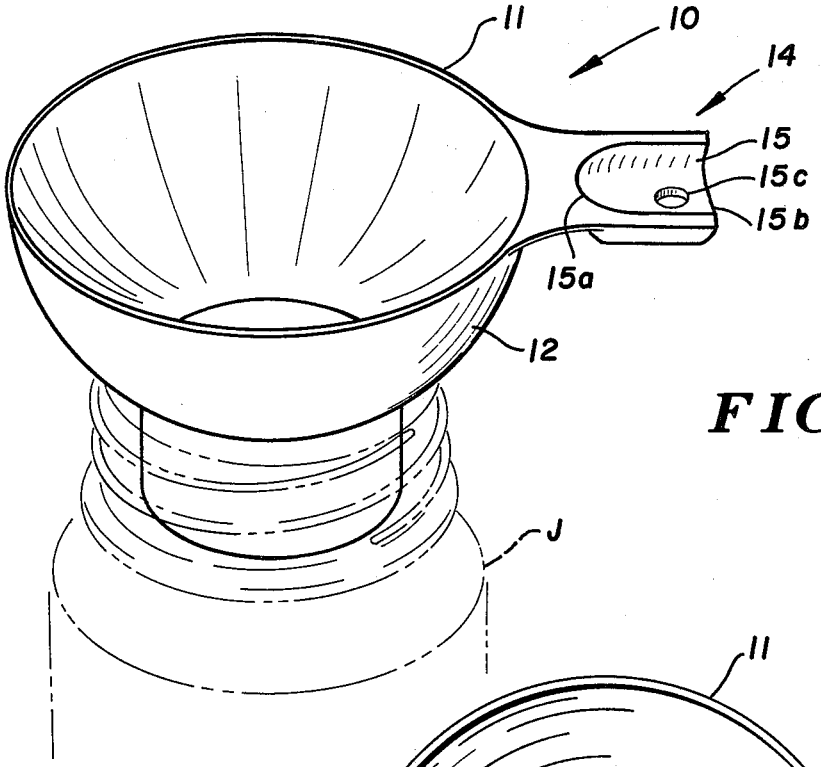
FIG. 1 is a perspective view of a funnel embodying the concepts of applicant's invention and illustrating the same in position upon the rim of a jar to be filled.
Figure 2:
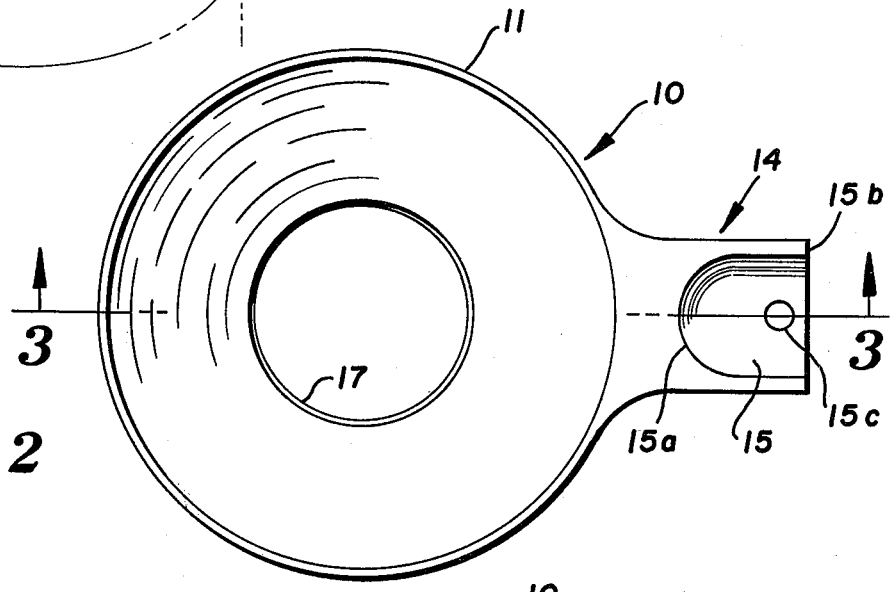
FIG. 2 is a top plan view of the funnel as illustrated in FIG. 1.
Figure 3:
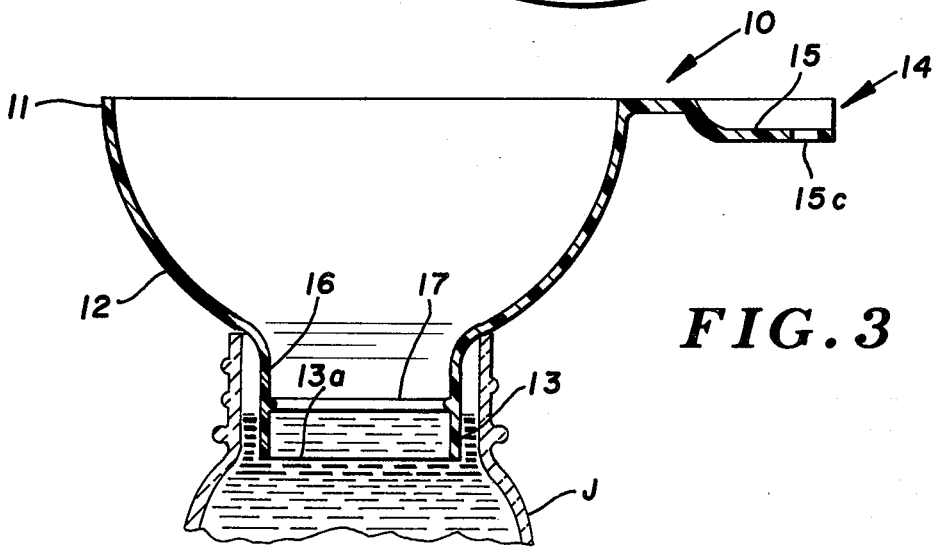
FIG. 3 is a vertical section taken substantially along Line 3—3 of FIG. 2 illustrating the funnel embodying the concepts of applicant's invention in place upon a jar and indicating the level of desired filling to one level.

In accordance with the accompanying drawings, applicant's funnel device is generally designated 10 and is illustrated in FIGS. 1 and 3 as being positioned upon a jar J within which food will be placed for its canning and preservation.

As illustrated in FIG. 3, the jar J upon which this funnel 10 will be most applicable is what is known in the trade as a small mouthed jar. It is easier to fill a wide mouthed jar than a small mouthed jar but it should be obvious that this funnel could be utilized with any type of jar simply by varying the dimension thereof without departing from the scope of applicant's invention.

Funnel 10 basically includes an upper receiving end 11 of generally circular configuration extending spherically downwardly as at body 12 to a lower delivery end 13 of a predetermined dimension which predetermined dimension is based upon the size of the jar upon which the funnel 10 will be used.

The upper end 11 of the funnel 10 is provided with a radially outwardly extending handle 14 which handle is of a predetermined width and which handle is provided with a depression area 15 which is smoothly radiused as at one end **15*a* thereof and which extends to the outer end 15*b* thereofalong straight sides tangent to the radius 15*a*. The depressed area 15 provides for a finger hold area and the aperture 15*c* may be provided in this depressed area for hanging of the funnel 10** when the same is not in use.

The spherically or hemispherically shaped body portion 12 between the upper receiving end 11 and the lower delivery end 13 provides a tapering surface which will provide for ease of filling of the funnel and delivery of the food to be inserted but the dimension thereof particularly at the lower end thereof is designed such that the ultimate end **13*a* of the funnel extends into the jar J to be filled a predetermined dimension. Therefore the exterior of the funnel provides a stop to rest against the jar. The delivery end 13 includes a generally cylindrical portion 16 smoothly flowing into the tapered spherical section 12 and having a length to permit the lower or ultimate end 13*a*** of the funnel to be positioned within the jar J at a predetermined distance.

Spaced upwardly from the ultimate end **13*a* of the funnel 10 is a generally cylindrical, interior ring which provides a marking indicia such that the level of the food to be inserted into the jar J may be controlled. As illustrated in these views, this indicia includes a total circular ring but it should be obvious that this indicia may be provided through various configurations which would extend radially inwardly of the delivery end 13. The applicant has found that this marking indicia 17 is most easily utilized when the same comprises such an inwardly directed element such as ring 17 rather than simply comprising a marking upon the surface of the inner portion of the delivery end 13.**

In order to provide two specific levels of filling, the ring 17 is spaced a predetermined distance from the utlimate end 13*a* of the funnel 10. This will then allow the user to use this ultimate end as a level indicia and will also allow the user to use the inwardly extending ring as a level indicia. Certain foodstuffs require filling of the jar to one of these levels while other foodstuffs will permit filling to the other of these levels. Obviously the entire design of the funnel which permits an exterior stop between the body 12 of the funnel 10 and the lip of the jar will predetermine the filling levels.

By controlling the insertion of food into the jar to the marking indicia 17 or the ultimate end 13*a* of the delivery end 13 of the funnel, a space is provided between the food and the upper rim of the jar J. This space will provide for expansion during heating of the jar and will allow for the driving of air from the foodstuffs and will also allow for drawing the cover downwardly as the jar and the food is cooling. It is essential that the cover not contact the food as it is drawn inwardly as this could prevent proper sealing of the lid to the top of the jar.

With applicant's funnel, it should be obvious that a relatively wide mouthed food receiving end is provided which will aid in the insertion of food into a jar without such food contacting the cleaned rim of the jar and which will further provide a proper control of the space between the filled jar and the lid being placed thereon by providing the delivery end of the funnel to be insertable into the jar a predetermined distance which will provide a first level of filling and by providing a level indicia within this delivery end which will provide a second level control.

What I claim is:

1. A funnel for filling of jars, said funnel including:

a. a generally tapered body portion having an enlarged receiving end and a delivery end of smaller dimension than the dimension of said receiving end;

b. said body providing a stop on the exterior of said enlarged receiving end to abut with the mouth of the jar;

c. said delivery end extending longitudinally from said receiving end, beyond said stop and the end thereof providing the sole means for introducing matter into the jar;

d. marking indicia being provided interiorally of said delivery end, being positioned between the end thereof and said stop and including at least one inwardly directed element visable from said receiving end whereby the filled level of the jar may be visually determined.

2. The structure set forth in claim 1 and said marking indicia including an internal ring member directed inwardly of said delivery end, said ring member being of an interior dimension to allow the matter for filling the jar to pass therethrough.

* * * * *